US008232505B2

(12) United States Patent
Hottenrott et al.

(10) Patent No.: US 8,232,505 B2
(45) Date of Patent: Jul. 31, 2012

(54) HAIR-STYLING DEVICE WITH GUIDE

(75) Inventors: Sebastian Hottenrott, Idstein (DE); Gisa Nicolin, Wiesbaden (DE); Duy Phong Vu, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 724 days.

(21) Appl. No.: 12/376,479

(22) PCT Filed: Aug. 9, 2007

(86) PCT No.: PCT/EP2007/007045

§ 371 (c)(1),
(2), (4) Date: Feb. 5, 2009

(87) PCT Pub. No.: WO2008/017478

PCT Pub. Date: Feb. 14, 2008

(65) Prior Publication Data

US 2010/0083978 A1 Apr. 8, 2010

(30) Foreign Application Priority Data

Aug. 10, 2006 (DE) ..... 10 2006 037 647

(51) Int. Cl.
*A45D 1/16* (2006.01)

(52) U.S. Cl. ..... 219/225; 219/244; 132/232

(58) Field of Classification Search ..... 219/244
See application file for complete search history.

(56) References Cited

U.S. PATENT DOCUMENTS

| | | | | | |
|---|---|---|---|---|---|
| 1,909,894 | A | * | 5/1933 | Protzky | 132/224 |
| 3,955,064 | A | * | 5/1976 | Demetrio et al. | 219/225 |
| 4,211,914 | A | * | 7/1980 | Jackson | 219/225 |
| 4,267,431 | A | * | 5/1981 | Rick et al. | 219/225 |
| 4,342,323 | A | | 8/1982 | Rick et al. | |
| 4,479,047 | A | * | 10/1984 | Khaja et al. | 219/225 |
| 4,533,819 | A | * | 8/1985 | Valiulis | 219/225 |
| 4,591,695 | A | | 5/1986 | Inoue | |
| 4,829,156 | A | * | 5/1989 | Thompson | 219/225 |
| 5,119,847 | A | * | 6/1992 | Powell et al. | 132/226 |
| 5,223,694 | A | * | 6/1993 | Tsuji et al. | 219/225 |
| 5,649,555 | A | * | 7/1997 | Harris | 132/238 |
| 5,832,939 | A | * | 11/1998 | Nathe | 132/225 |
| 6,627,852 | B1 | | 9/2003 | Savone | |
| 6,667,462 | B2 | * | 12/2003 | Lo | 219/225 |
| 2004/0089317 | A1 | * | 5/2004 | McCambridge et al. | 132/232 |

FOREIGN PATENT DOCUMENTS

| | | | |
|---|---|---|---|
| DE | 196 18 876 | | 11/1997 |
| DE | 197 48 067 | | 5/1999 |
| DE | 202 18 747 | | 4/2003 |
| EP | 1 733 642 | | 12/2006 |
| JP | 54-135062 | A | 10/1979 |
| KR | 20-0270330 | * | 3/2002 |
| WO | WO2006/044570 | | 4/2006 |

* cited by examiner

*Primary Examiner* — Joseph M Pelham
(74) *Attorney, Agent, or Firm* — Jeffrey V Bamber; Kim W Zerby

(57) ABSTRACT

A hair-styling device having an essentially cylindrical heating part on which at least one heatable styling part is provided for heating the hair. At least one lateral limit of the styling part is designed here as a styling edge. At least one guide means is arranged around the styling part in at least some areas, with a guide edge running parallel to the styling edge.

11 Claims, 8 Drawing Sheets

HAIR-STYLING DEVICE WITH GUIDE

TECHNICAL FIELD

The present invention relates to a hair-styling device with a heating part designed to be essentially cylindrical, having a heatable styling part with a styling edge for heating and styling the hair and a method for styling hair.

BACKGROUND

Hair-styling devices such as curlers, straighteners or rollers are provided for styling hair, in particular for styling strands of hair. Depending on the relative moisture of the hair to be styled, a strand of hair to be styled must first be brought to a range of easy stylability, which is between 120° C. and 175° C.

The strand of hair heated to a predefined temperature is pulled over a rounded edge of the hair-styling device in the hair-styling process to induce a permanent and targeted curvature in the respective strand of hair. This results in a temporary shaping and curvature of the hair which results in the formation of a curl. The degree of shaping depends on various factors.

If a strand of hair is pulled out of the heated styling zone of the hair-styling device in a straight line and without prior cooling, this usually leads to an unwanted cancellation of the styling effect or straightening of the hair, which may be complete under some circumstances.

To maximize the cooling effect, a curved cooling surface having the same direction of curvature as the styling edge follows the hair-styling devices known from the state of the art. This curved cooling surface cools the strand of hair along its length to a temperature that is not critical for the shaping. Such a hair-styling device is described in DE 197 48 067 A1, for example.

With hair-styling devices having a cooling surface and a styling edge, a strand of hair to be styled is clamped at the base of the hair by the device and is pulled through the strand of hair as far as the tip of the hair in the styling process. In handling of such devices, it is typically necessary for the entire hair-styling device, typically designed in the form of a rod, to be rotated about its longitudinal axis after clamping the strand of hair, so that the clamped strand of hair is pulled over the styling edge at a predefined radius of curvature and also in close proximity is pulled over the cooling surface which follows the styling edge.

The hair-styling device known from DE 197 48 067 A1 also has an asymmetrical design. To achieve an optimum styling effect, the device is rotated in a predefined direction after clamping the strand of hair that is to be styled. If the user rotates the device incorrectly in the other direction, then the strand of hair to be styled is no longer passed over the cooling surface, which can have a very negative effect on the styling result if waving or curling of the hair was intended.

In addition, handling of such devices that must be rotated during use is complicated and requires some skill and practice on the part of the user to obtain a satisfactory hair-styling result.

SUMMARY

The hair-styling device is preferably designed as a hand-held device with a grip part and with a heating part shaped essentially in the form of a rod or a corresponding section of hair. The heating part has at least one heatable styling part for heating the hair, such that at least one but preferably both side boundaries of the styling part are designed as a rounded styling edge. To design a guide for the hair, at least one guide means is provided and is adjustably mounted with respect to the styling part.

After inserting the hair into the hair-styling device, the guide means and styling part may be adjusted or shifted toward one another, so that the strands of hair experience a forced guidance within the hair-styling device.

Due to the guidance of an inserted strand of hair as defined by the guide means, this strand of hair may be pulled over the styling edge of the styling part following exactly a predefined angle or a predefined and optimized path. In this way, a uniform and optimized styling result can be obtained; this can be achieved independently of any rotation of the hair-styling device around the strand of hair inserted into it.

The guide edge and styling edge are designed to run parallel to one another but they are arranged offset from one another, so that the hair strand is forced to follow a predefined curved path as it is pulled through the hair-styling device. Alternatively, the forced guidance of the hair in the guide means is also achieved even when the guide edge and the styling edge are not designed to be parallel.

Due to the forced guidance provided by the guide means and the styling part, faulty use or faulty operation of the device, such as that caused in the state of the art due to improper rotation and/or handling (in which the strands of hair are not pulled over the cooling surface and/or are pulled into a detrimental curvature) is practically prevented.

In some configurations, the at least one guide means is arranged around the styling part and also around the guide edge in at least some areas. In at least one possible position of the guide means, it surrounds the styling edge of the styling part in at least some areas. The guide means has a side border designed as a guide edge running essentially parallel to the styling edge of at least one styling part.

The guide edge of the guide means serves either as an inlet or as an outlet for the strand of hair and together with the guide means forms a forced guidance for a strand of hair that can be clamped in the device.

The at least one guide means and the heatable styling part have geometries adapted to one another, forming a curved gap in the closed position of the hair-styling device. Due to this, the strand of hair inserted into the hair-styling device experiences a forced guidance in pulling the device through the strands of hair. Manual rotation of the entire hair-styling device with the strands of hair inserted into it is no longer necessary due to the forced guidance formed by the guide means and the styling part. The use of the device is therefore simplified.

Both the guide edge and the styling edge run essentially perpendicular to the course of the strand of hair inserted into the device in a typical application of the device.

According to another embodiment, the guide means and the styling part are mounted so they are pivotable or rotatable toward one another. The mutual pivoting or rotation of the styling part and the guide means take place here preferably after insertion or clamping of a strand of hair in the hair-styling device. After completely pulling the strand of hair through the device, the guide means and the styling part may again be pivoted or rotated toward one another in opposite directions to thereby move the device to a starting position in which another strand of hair may be subjected to the styling process in the same manner.

In some examples, the at least one guide means and the at least one styling part are mounted to rotate toward one another about the cylinder axis of the heating part. The guide means, for example, may thus be rotatable about a stationary styling part. In another embodiment, however, the styling part may also be mounted to be rotatable with respect to a stationary guide means. In addition, it is also conceivable for both the guide means and the styling part to be mounted to rotate with respect to a stationary cylinder axis of the heating part.

It is provided here in particular that in an open position of the hair-styling device both the styling edge and the guide edge come to lie approximately in direct proximity to one another. After insertion of the strands of hair and closing the device, the inserted strands of hair may be rotated and forcibly guided in at least some areas within the device due to the relative rotation of the styling part and the guide means, so that the strands of hair are optimally pulled over the styling edge as well as over the cooling surface in being pulled through.

In addition, at least one styling part has a heating surface on the interior and a cooling surface which is curved outward and is surrounded in at least some areas by the guide means. The heating surface of the styling part may have various designs such as flat, arched or curved.

It is provided in particular that the guide means surrounding the arched cooling surface of the styling part in at least some areas is designed like a shell. The guide means in the area of the heating surface of the styling part is preferably designed as a half-shell, so that when the device is closed, a guide gap formed according to the radius of curvature of the cooling surface is created between the styling part and the guide means, so the strand of hair can be pulled through this gap during its use.

In state in which the styling part and guide means are rotated toward one another, the styling edge preferably comes to lie in an area that is completely surrounded or covered by the guide means, so that the strand of hair cannot be passed over the styling edge in a straight line but instead must always follow the given radius of curvature when it is pulled over the styling edge and the subsequent cooling surface or cooling zone.

In addition, two styling parts that are pivotable toward one another like pliers are provided, and heating surfaces are arranged opposite one another in a closed position of the device, forming a gap for the hair. This embodiment allows a cylindrically symmetrical design of the heating part in which two styling parts that are preferably designed similarly as half-cylinders can be folded toward one another.

With a corresponding curvature of the cooling surfaces of the styling parts on the outside, an essentially circular or elliptical cross-sectional profile may be formed. Additional cross-sectional profiles, such as a rectangular or essentially triangular profile are also conceivable.

Due to the use of two styling parts, each having a heating surface, the heating effect may be increased, so that the required use time can be reduced. Furthermore, such a symmetrical arrangement of the styling parts offers the advantage that a styling edge may be provided on each side boundary of the planar heating surface, so that when using the device, regardless of the direction in which the hair strand is pulled through and regardless of a relative direction of rotation of the styling parts and the guide means, uniform shaping results can always be achieved.

It thus does not matter whether the styling part is rotated clockwise or counterclockwise relative to the guide means after a strand of hair has been inserted, because a uniform and equally curved cooling surface follows each of the two styling edges of the styling parts running in the axial direction.

In some configurations, a guide means designed in the form of a half-shell is provided for each of the styling parts that are pivotable toward one another, said guide means being displaceable in the circumferential direction of the styling part along the curvature of the outwardly arched cooling surface of the styling part, so to speak, and/or arranged to rotate on the respective styling part with respect to the cylinder axis of the heating part.

In some cases, the at least one styling part surrounded in some areas by the guide means protrudes at its free end beyond an axial limit of the at least one guide means. This serves to facilitate handling, in particular when the guide means and the styling part are to be rotated manually toward one another after closing the device and after the strand of hair has been inserted.

It is provided hereby in particular that the free end of the styling part protruding beyond the axial limit of the guide means has at least one grip shell on its outside. Thus in particular the free end of the heating part which serves as the grip part is not cylindrical but instead is preferably designed with a beaked shape with an inward concave curvature. The grip end, which is designed with a taper with respect to the lateral surface of the cylinder of the heating part allows a more secure and simple relative rotation of the entire heating part with respect to the guide means, which is advantageous in particular with respect to the high temperature of the heating surfaces during operation of the device.

In some examples, the guide means, which are designed in the form of half-shells in at least some areas and surround the two styling parts in some areas are mounted so they can be pivoted toward one another like pliers. Thus the hair-styling device has an inside group consisting of styling parts that can be pivoted toward one another like pliers and an external module formed by shell-shaped guide means that can also be folded together like pliers.

In some configurations, the heating part is mounted to rotate about its cylinder axis within the guide means. The cylinder axis refers here to the cylindrical shape of the heating part in the closed state, i.e., in the closed position. In comparison with an embodiment in which the individual half-shells of the guide means are arranged individually, each on a neighboring styling part, this embodiment has an internal module and an external module, each being designed like pliers and mounted to rotate toward one another about the axis of the cylinder of the heating part. The pliers-like module situated on the outside of the guide means thus encloses the internal module, which is also designed like pliers, with the styling parts.

It is advantageous here if the internal module having the inner part and the external module forming the guide means are connected to one another by a pivot joint. The pivot joint here is preferably provided in the area of the pivot axis of the guide means, such that the axis of rotation of the pivot joint and the pivot axis of the guide means are aligned so they are perpendicular to one another.

In some instances, one of the styling parts of the heating part is mounted to rotate on the inside of at least one the guide means by means of bearing pins running in the axial direction. The guide means preferably has a corresponding bearing bushing for this purpose in which the bearing pin, preferably connected to the styling part in one piece, is inserted. However, a reversed arrangement of the bearing bushing and the bearing pin is also readily conceivable accordingly.

In some arrangements, the pivot axis of the two styling parts and the pivot axis of the two guide means are rotatable in both directions up to 180 degrees, preferably up to 120 degrees in the closed position of the device or they are rotatable about the cylinder axis of the heating part in a range from at least 60 degrees or up to 170 degrees. The rotatability in both directions and the symmetrical embodiment of the two styling parts and guide means that can be folded toward one another allow an operation that is independent of direction and allow handling of the hair-styling device. The styling parts and the guide means are at least mounted to rotate up to the angles given above. On reaching the above rotational positions, a limitation on the angle of rotation may be provided to thereby preset a reasonable range of rotation for the user. Due to the maximum upper angle of rotation of 60 degrees or up to 170 degrees defined above, the dwell time of the strand of hair in the cooling area is determined at an assumed average pull-through rate and thus the optimal styling in the cooling area is determined.

The direction of rotation of the oppositely rotatable modules as well as the direction in which the strand of hair pulled through the hair-styling device thus no longer play a role. Thus any faulty operation or defective use of the device can be prevented. This ultimately leads to improved and easier handling as well as better results in the hair-styling process.

In some examples, there is a relative rotation of the styling parts with respect to the guide means due to pivoting of the guide means into the closed position of the device. The relative rotation of the styling parts with respect to the guide means that can be induced by closing said guide means allows semiautomatic operation of the device. By moving the device to the closed position, the rotation of the internal module with respect to the external module which is necessary for the forced guidance of the strand of hair may thus take place automatically in one step.

In addition, a locking device is provided, which allows a relative rotation of the styling parts and guide means only in the closed position of said styling parts and/or guide means. This locking function ensures that insertion of the strand of hair into the device always takes place in a starting position of the hair-styling device and a relative rotation of the internal and external modules is possible only when the device is closed.

This ensures that the rotation or adjustment of the modules which leads to the forced guidance of the strands of hair can take place only when the strand of hair has been inserted.

It is also provided here that the closed position of the device and the styling parts and/or the guide means is locked in the operating position, in which the styling parts are rotated with respect to the guide means. This prevents the internal and external modules, which are rotated toward one another into the operating position from being opened during operation and/or from being moved into the open position.

This type of locking is especially important against the background that the modules that are rotated toward one another cannot be moved from the closed position to the open position in the rotated state because of their geometric design, because the pivot axis of the styling parts runs obliquely to the pivot axis of the guide means. However, in the open position or starting position of the hair-styling device, these two pivot axes of the internal and external modules are preferably aligned parallel to one another.

In some examples, a compression spring is provided for bringing the guide means together in the closed position, supporting the closing movement and thus allowing easier handling of the device.

A torsion spring may be provided for opening the styling parts out of the closed position and into the open position, this spring coming to lie in the area of the pivot axis joining the two styling parts together. This torsion spring supports an opening of the internal module. The two styling parts are pressed apart from one another by the torsion spring.

These two springs acting in different directions cause the device to be movable into only one defined open position in which the two styling parts are opened up and each remains in contact with the guide shell surrounding it. This prevents improper insertion of the hair strand between the outside of a styling part and the inside of a guide shell, for example.

In some configurations, a motor drive is provided for relative rotation of the styling parts and guide means. The rotation of the internal and external modules may be accomplished without the intervention of the user in an automatic manner, e.g., after engagement of the styling parts or guide means that can be folded together.

In addition, for controlling the motor drive and/or for detecting the operation or the operating mode of the device, a sensor system having sensor elements and a corresponding controller are provided. With the help of optical or pressure-sensitive sensors, for example, the open position or the closed position of the device can be detected. Finally, a control unit can control the motor drive for a relative rotation of the internal and external modules, depending on the position detected.

In addition it is possible to ascertain by means of appropriate sensors, for example, whether the hair strand has already been pulled completely through the device. Thus device constellations which lead in such a case to automatic reverse rotation of the modules and opening of the device are conceivable, which further simplifies general handling.

Improved hair-styling devices and methods for styling hair are featured, which will allow easier and thus more user-friendly handling, and with which uniformly good styling results can be achieved.

Additional goals, features, properties and advantageous possible applications are derived from the following description of exemplary embodiments with reference to the drawings. All the features described and/or illustrated in figures in their reasonable combination form the subject matter of the description, even independently of the patent claims or their reference back to previous claims.

DETAILED DESCRIPTION

Figure 1A:
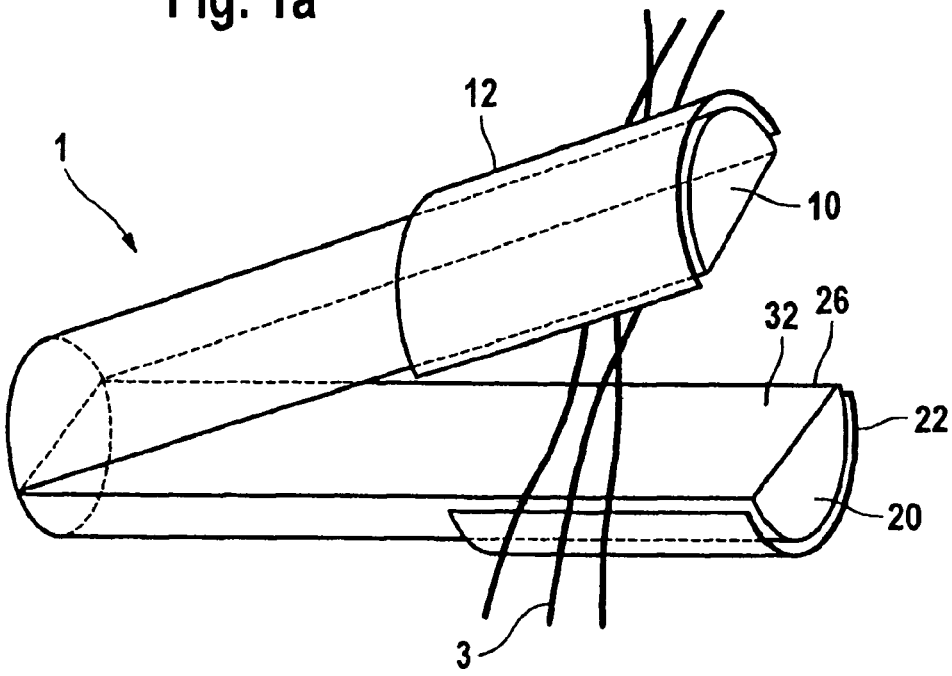
FIG. 1*a* shows a schematic three-dimensional diagram of a first embodiment of the hair-styling device in the open position with the strand of hair inserted.
Figure 1B:
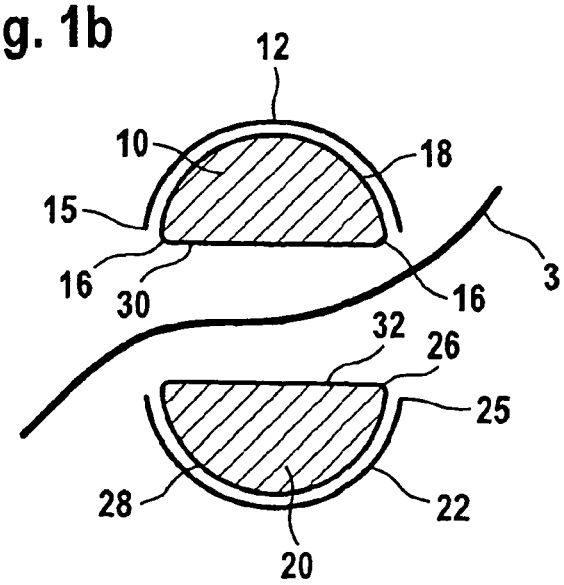
FIG. 1*b* shows a cross-sectional diagram of the device with the strand of hair according to FIG. 1*a;*

FIGS. 1*a*, 1*b*, 2*a*, 2*b*, 3*a* and 3*b* illustrate a first embodiment of the hair-styling device with two styling parts 10, 20 pivotable toward one another. The styling parts 10, 20 have a heating surface 32 that is designed to be essentially planar on their inside, said heating surface being bordered at the sides by a rounded styling edge 16, 26. The outside of the styling parts 10, 20 adjacent to the styling edges 16, 26 is designed as the cooling surface 18, 28 along which the hair 3 that is guided over the styling edge 16, 26 can be guided for cooling after styling.

Although the illustrations from FIGS. 1*a* through 3*a* above illustrate the hair-styling device in a perspective view, the device is shown in cross section in the respective lower parts of FIGS. 1*b* through 3*b*.

Figure 2A:
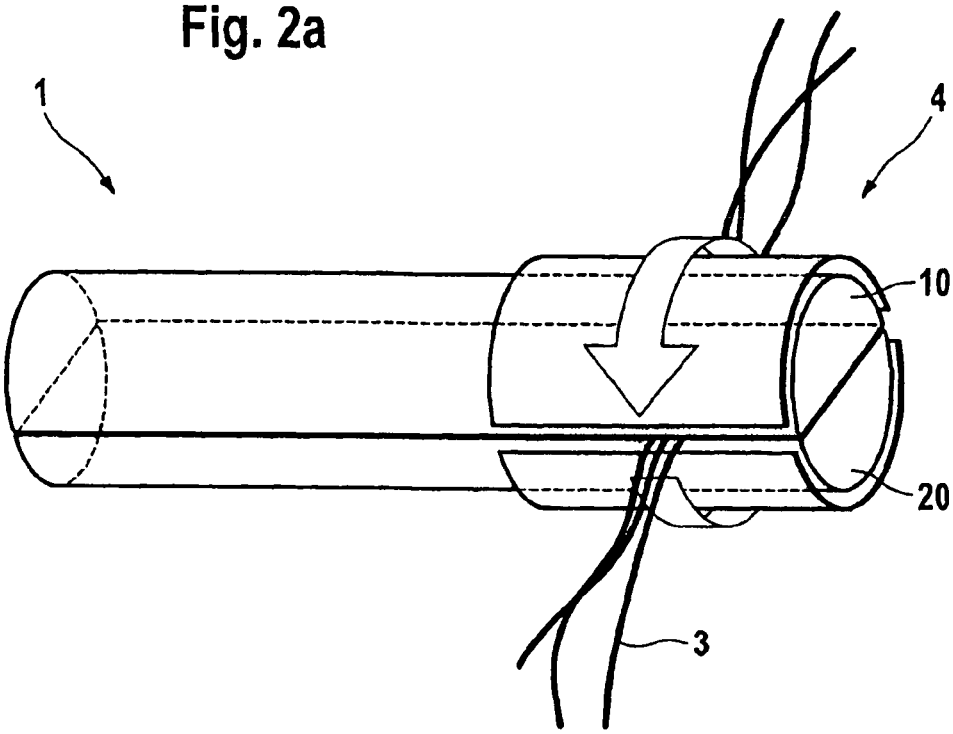
FIG. 2*a* shows the device according to FIG. 1 in the closed position.

The free end of the styling parts 10, 20 that can be pivoted like pliers is surrounded in some areas by a guide means or guide element 12, 22 designed like a shell, along the outside of the styling parts 10, 20. In the starting position illustrated in FIGS. 1*a* and 1*b*, each of the styling parts 10, 20 is surrounded by a corresponding guide shell 12, 22 along its arched exterior. The strand of hair 3 that can be inserted between the styling parts 10, 20 comes to lie directly on the flattened interior heating surfaces 30, 32 of the two styling parts 10, 20 in the closed position of the device as illustrated in FIGS. 2*a* and 2*b*.

Figure 2B:
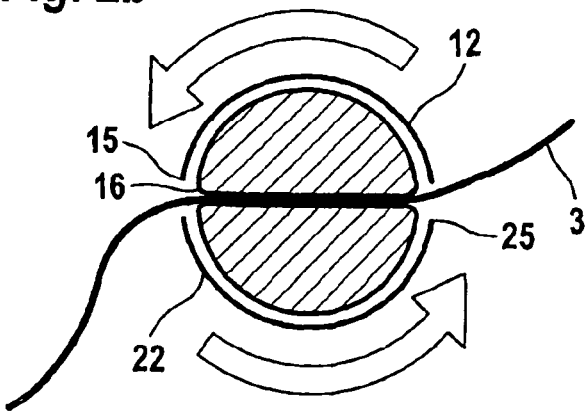
FIG. 2*b* shows a cross-sectional diagram of the device according to FIG. 2*a;*

According to the cross-sectional diagram in FIG. 2*b*, the heating part 4 of the hair-styling device 1 has an essentially cylindrical geometry, which allows a relative rotation of the styling parts 10, 20 and the guide shells 12, 22.

Figure 3A:
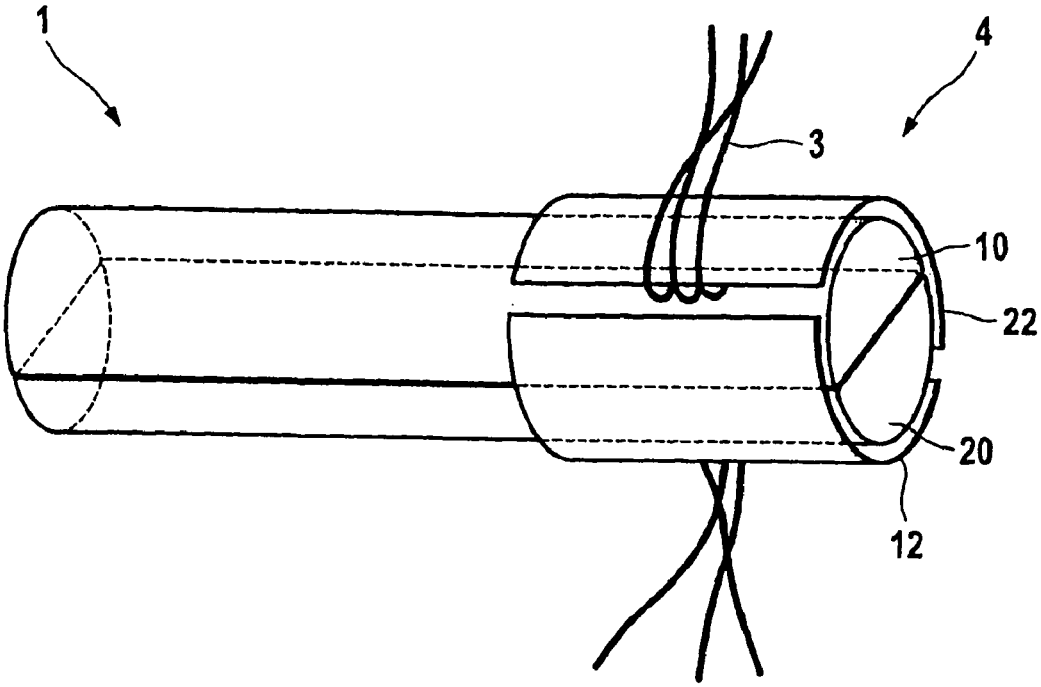
FIG. 3*a* shows the device according to FIGS. 1 and 2 in a closed and rotated diagram.
Figure 3B:
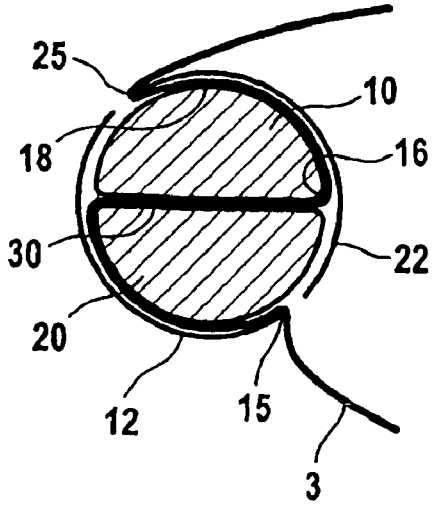
FIG. 3*b* shows a cross-sectional diagram of the device according to FIG. 3*a;*
Figure 4A:
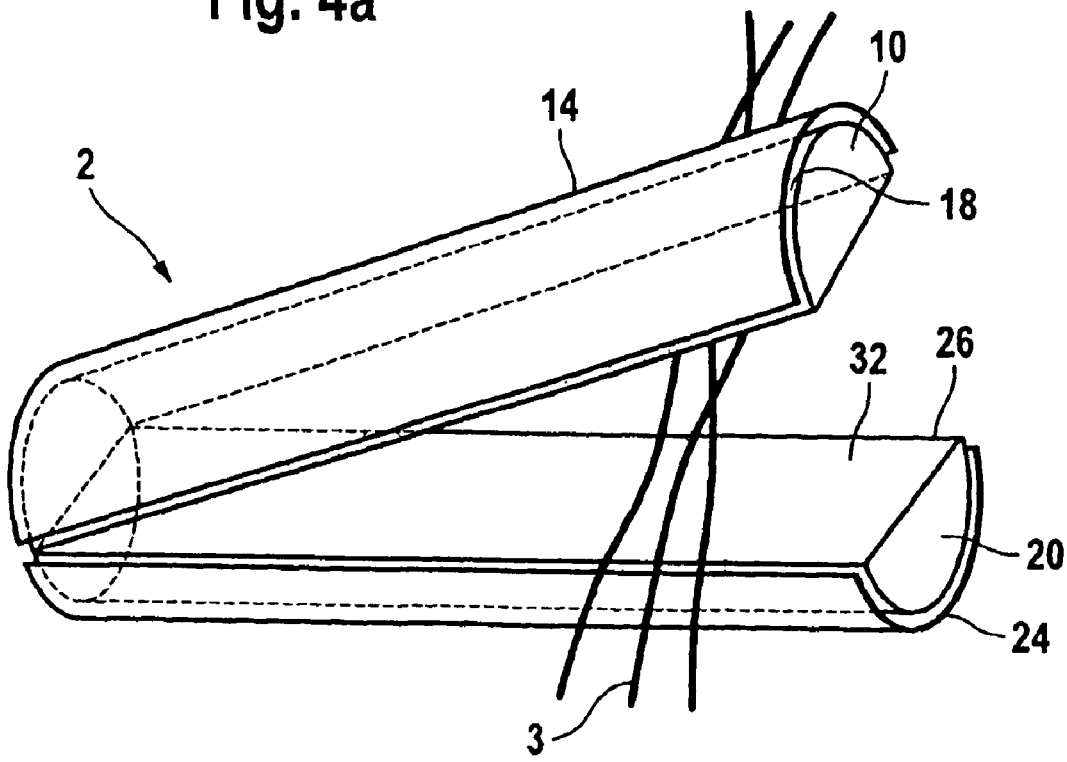
FIG. 4*a* shows a schematic three-dimensional diagram of a second embodiment of the hair-styling device with the strands of hair inserted in the open position.
Figure 4B:
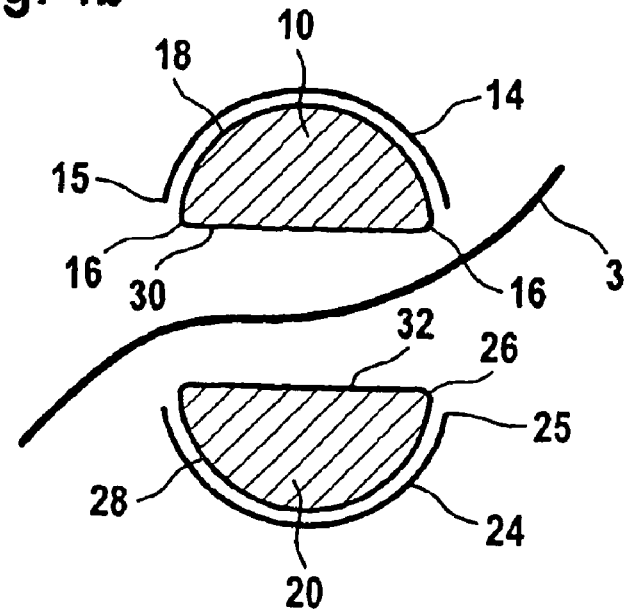
FIG. 4*b* shows a cross-sectional diagram of the device according to FIG. 4*a;*

FIGS. 3*a* and 3*b* show the configuration of the device 1 in the rotated operating state, which can be achieved by displacement or rotation of the guide shells 12, 22 along the outside curvature of the styling parts 10, 20.

Due to the relative rotation of the guide shells 12, 22 with respect to the styling parts 10, 20, the strand of hair 3 inserted into the device is subjected to a forced guidance in passing it through the device, such that it is always certain that the strand of hair 3 pulled over the guide edges 15 of the guide shell 12 will be pulled through between the flat heating plates 30, 32 of the styling parts 10, 20, curved over the styling edge 16 of the styling part 10 and cooled on the cooling zone 18 of the styling part 10 before ultimately leaving the hair-styling device 1 via the guide edge 25 of the guide shell 22.

Due to the rotation and/or adjustment of the guide edges 15, 25, which are provided by the guide shells, and the styling edges 16, 26, a forced guidance of the hair strand 3 within the hair-styling device 1 is thus achieved and is optimized first with regard to the radius of curvature of the hair strand about the styling edge 16, 26 and also with regard to contact of the strand 3 with the cooling surface 18.

Whereas the embodiment illustrated in FIGS. 1*a* to 3*b* is based on a rotation of the guide shells 12, 22 with respect to the styling parts 10, 20, the variant of the hair-styling device illustrated in FIGS. 4 to 10 is based on an alternative adjusting mechanism in which the styling parts 10, 20 are almost completely surrounded by guide means 14, 24 and both the guide means 14, 24 on the outside and the styling parts 10, 20 on the inside are arranged so they can be pivoted toward one another like pliers.

The hair strand 3 is inserted between the heating plates of the styling parts 10, 20 that are on the inside and are designed to be flat by a method similar to that used in the exemplary embodiment described above. With the hair-styling device 2 illustrated in FIGS. 4*a* to 10, the guide shells 14, 24 on the outside form a part of the device housing in which the styling parts 10, 20 that can be pivoted toward one another like pliers are mounted, so they can rotate as a whole.

Figure 5A:
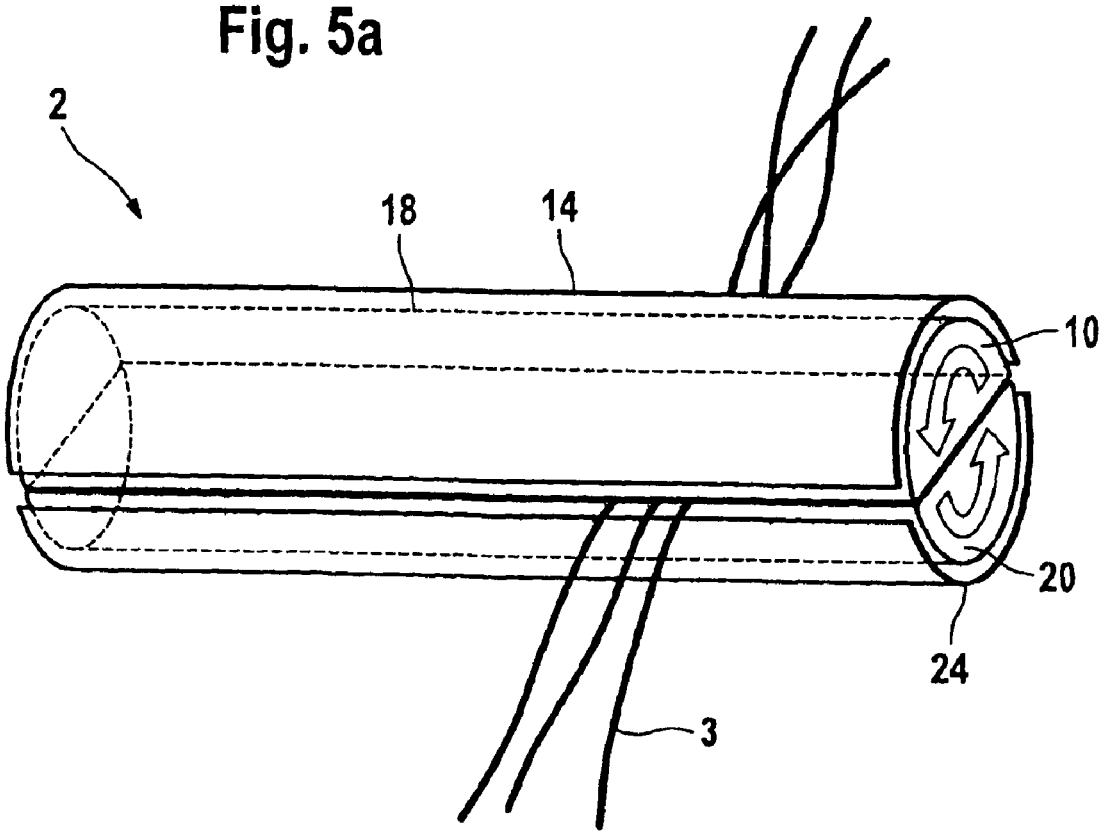
FIG. 5*a* shows the device according to FIG. 4 in the closed position.
Figure 5B:
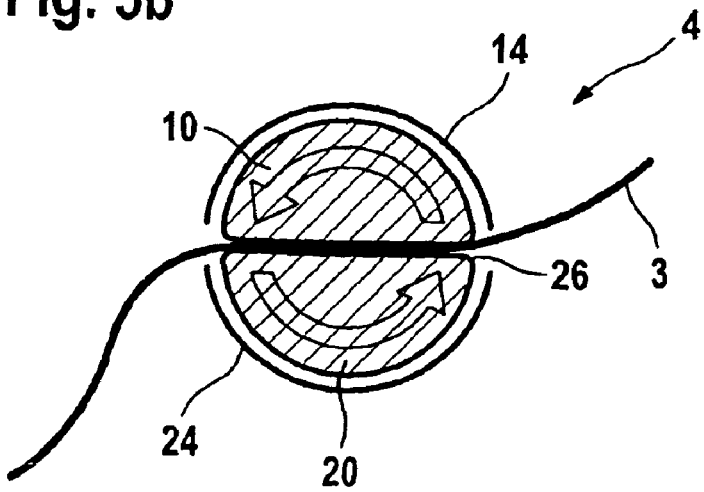
FIG. 5*b* shows a cross-sectional diagram of the device according to FIG. 5*a;*
Figure 6A:
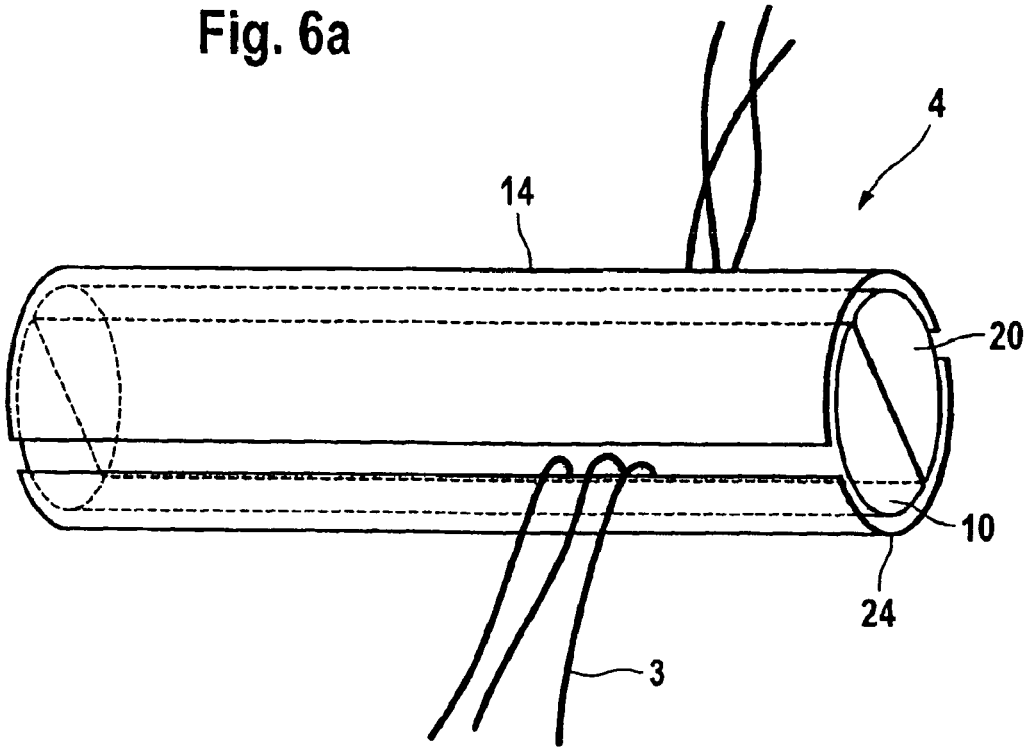
FIG. 6*a* shows the device according to FIGS. 4 and 5 in a closed and rotated diagram.
Figure 6B:
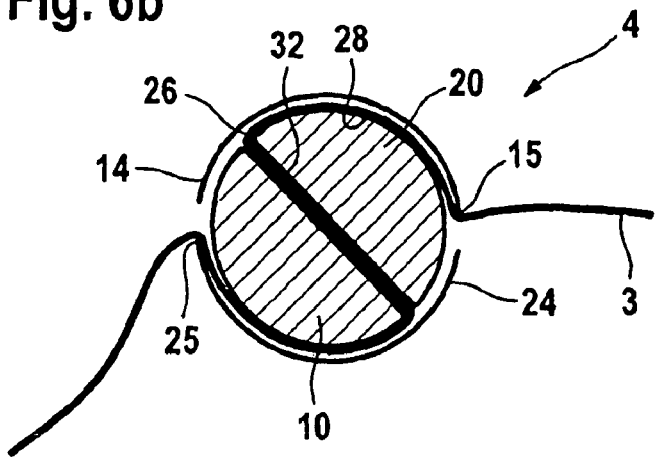
FIG. 6*b* shows a cross-sectional diagram of the device according to FIG. 6*a;*

FIGS. 5*a* and 5*b* show a possible counterclockwise rotation of the styling parts 10, 20 as an example. Such a rotation leads to the rotated state illustrated in FIGS. 6*a* and 6*b*, in which the hair strand 3 has been pulled into the device over the guide edge 25 of the guide shell 24, then pulled between the two heating plates 30, 32 of the styling parts 10, 20, shaped on the styling edge 26 and ultimately guided over the cooling surface 28 of the styling part 20 before the hair strand 3 leaves the hair-styling device 2 via the guide edge 15 of the guide shell 14.

FIGS. 7 to 9*b* illustrate a configuration of the hair-styling device 2 as a rod-shaped essentially cylindrical device corresponding to that in FIGS. 4*a* to 6*b*. In one variant, the device is designed to be cropped over the longitudinal extent. The guide means 14, 24 designed as a half-shell form an exterior housing of the hair-styling device 2 which has a grip surface 50 in the area of the pivot axis 34. The heating part 4, which also has two styling parts 10, 20 pivotable toward one another like pliers, is mounted so it can rotate within the guide shells 14, 24 that can be pivoted toward one another like pliers. The free ends of the styling parts 10, 20 facing away from the grip surface 20 are designed as grip shells 46, 48 flattened in a beaked shape, thus allowing easy and more secure relative rotation of the external structural unit 14, 24 and the internal structural unit 10, 20.

Figure 10:
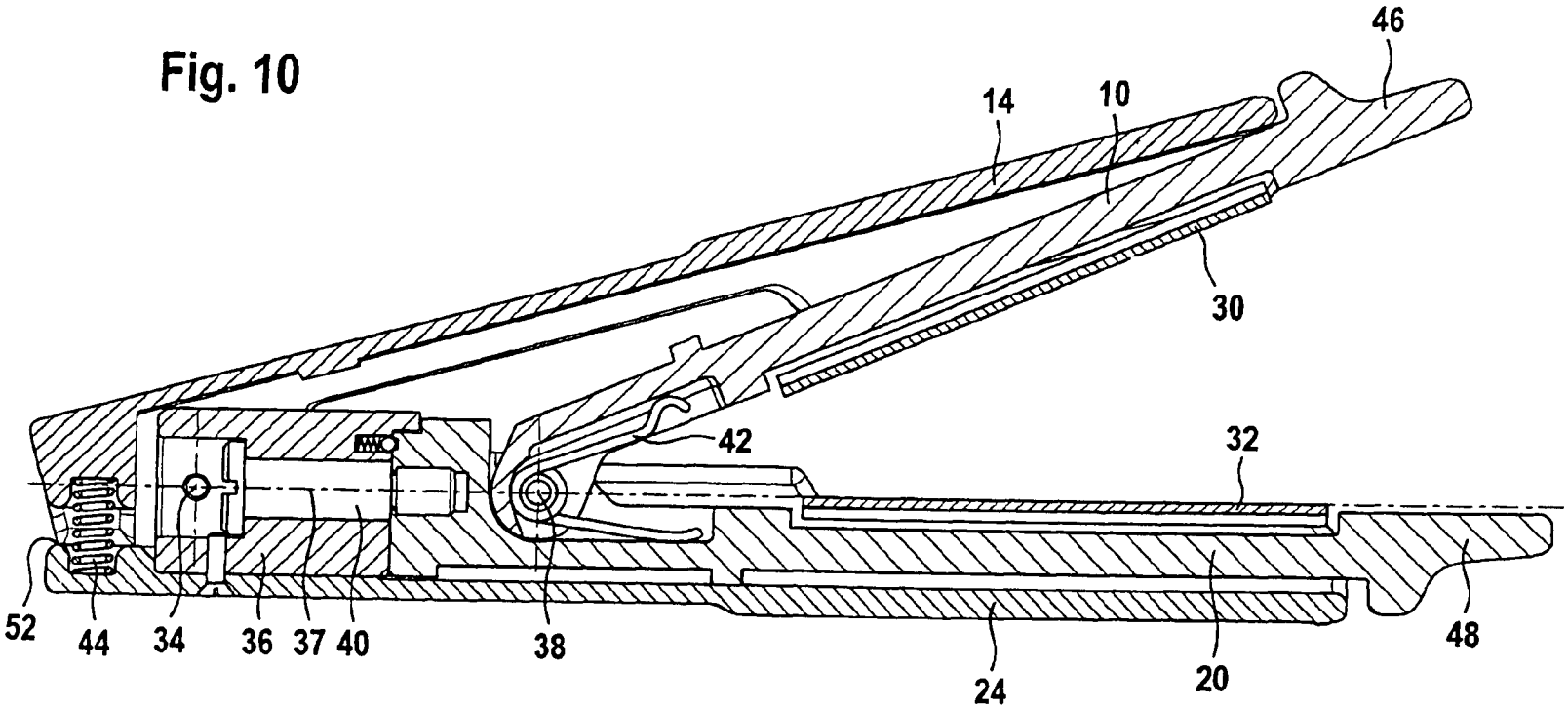
FIG. 10 shows the device according FIG. 7 in a longitudinal section.

The longitudinal cross-sectional diagram according to FIG. 10 shows the two modules designed like pliers. Whereas the two styling elements 10, 20 having heating surfaces 30, 32 on their insides are mounted and arranged so they can be pivoted toward one another via the pivot axis 38, a pivot axis 34 is provided for the external module having the guide shells 14, 24. Guide elements and styling elements which are joined together in pairs like pliers are thus arranged one inside the other. The inside of the guide means and/or the outside of the styling parts, i.e., the cooling zone has/have transverse ribs over which the strand of hair is guided in pulling it through the device, so that the strand of hair cannot move diagonally over the device.

The internal module having the heatable styling parts 10, 20 is connected as a whole within the external module formed by the upper and lower grip shells and/or guide shells 14, 24 by means of a pivot joint. The pivot joint here has a bearing and/or a hub 36 connected to the external module and has a pin 40 connected to the internal module 10, 20, allowing a relative rotation of the internal and external modules with respect to the axis of rotation 37.

Figure 8A:
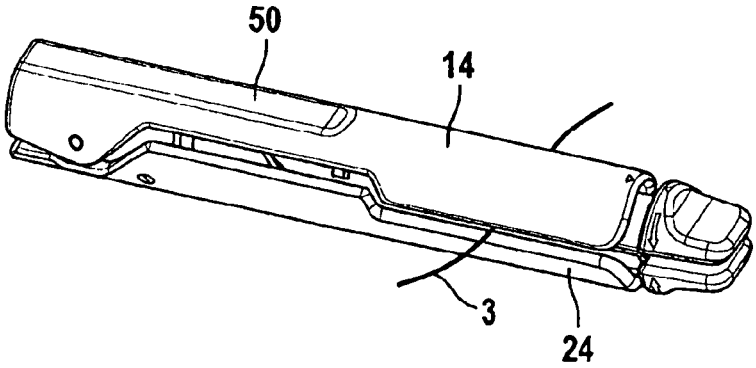
FIG. 8*a* shows a perspective diagram of the device according to FIG. 7 in the closed position.
Figure 8B:
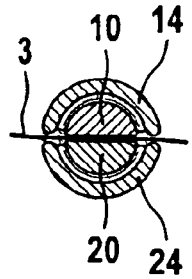
FIG. 8*b* shows a cross-sectional diagram of the device according to FIG. 8*a;*
Figure 9A:
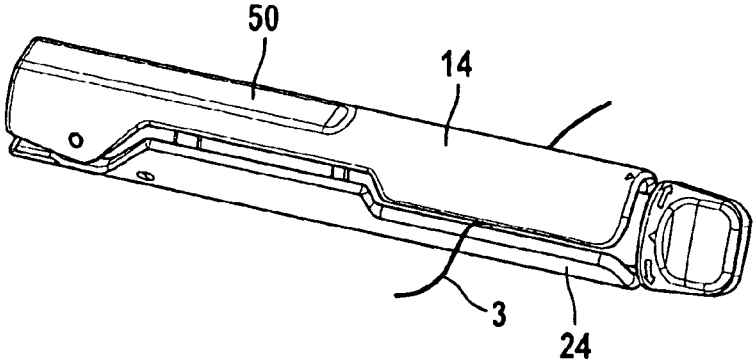
FIG. 9*a* shows a perspective diagram of the device according to FIGS. 7 and 8*a* in a closed and rotated configuration.
Figure 9B:
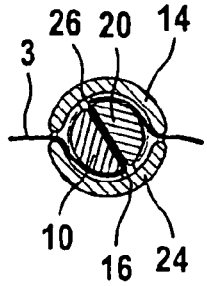
FIG. 9*b* shows a cross-sectional diagram of the device according to FIG. 9*a;*

The axis of rotation 37 coincides in particular with the longitudinal axis of the heating part 4 that is designed as a cylinder when the latter is in the closed position, as illustrated in FIG. 8*a* or 9*a*.

In addition, a compression spring 44 is provided, arranged in the area of the outer pivot axis 34 and supporting a closing movement of the device 2 and/or of the guide shells 14, 24. The internal module, however, has a torsion spring 42 which forces the two styling parts 10, 20 apart in the area of their pivot axis 38.

Figure 7:
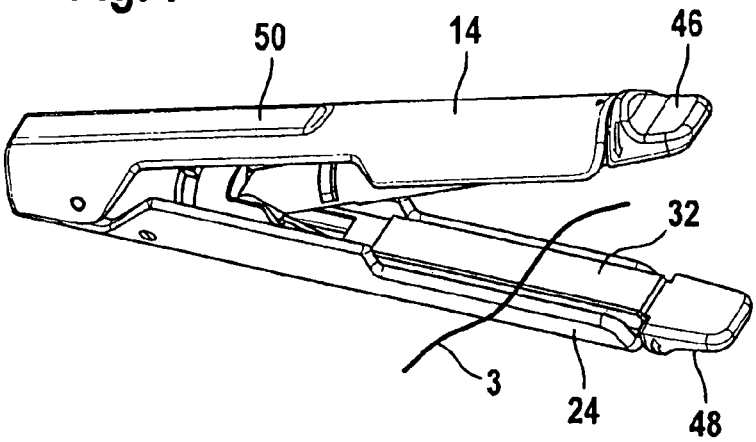
FIG. 7 shows a detailed perspective diagram of the device with the external and internal modules rotated toward one another in the open position and with the strand of hair inserted.

Due to these spring mechanisms acting in opposite directions, this ensures that the two pliers-like modules arranged one inside the other do not open or close independently of one another. Thus the two springs cause the device 2 to always be movable into the same open position as illustrated in FIG. 7, for example. The risk of faulty operation, e.g., by clamping a strand of hair 3 between a guide shell 14 and the cooling surface 18, 28 of a styling part 10, 20, is thus counteracted.

In addition, a stop 52 or an opening limit is formed in the area of the compression spring 44 on the guide shells 14, 24. In this way a maximum opening angle for the two guide shells 14, 24 can be preselected.

The hair-styling device according to FIGS. 1*a* through 10 is preferably used as follows. While still wet, a strand of hair is inserted between the styling parts in the area of the base of the strand of hair, at least one part of which is heated. The design of the hair-styling device up to this point is comparable to that of a hair straightener that can be opened like pliers and is thus handled similarly. According to the state of the art, the device is now held at an angle and the strand of hair is pulled through the styling part surfaces that are opposite one another when the device is closed like pliers, so that the heated hair is guided over the styling edge (having a curved cross section) (this is, for example, a side edge of the styling parts) and is passed over the cooling surface on the back side of the styling parts. This creates a wave or a curl in the hair. However, in the case of the hair-styling device according to FIGS. 1*a* to 10, after insertion of the hair strand and bringing the heating surface of the styling parts together, the lengthened ends 48 of the styling parts are held together and rotated relative to a housing section surrounding the styling parts, namely the guide means, up to a stop, rotating by 120 degrees, for example (up to an angle between 60 degrees and 170 degrees). The hair-styling device is designed so that the hair is automatically and forcibly guided between the outside of the styling parts (i.e., the cooling areas for the hair strand) and the guide means as a result of this rotation. Since guide means are preferentially provided on both exterior sides of the styling parts for simpler handling, the hair is forcibly guided in the guide means as a result of this rotation not only after heating but also before heating, so that the hair strand passes through an approximately S-shaped curve in the device from the entrance in the one guide edge (this closes the guide in the guide means and forms an opening slot to the outside of the housing) up to the outlet on the opposite guide edge. That strand of hair is thus pulled through the device in the rotated and closed state thereof, from the base of the hair to the end of the hair. Only then is the device returned to the unrotated and opened position (in which the styling edge and the guide edge preferably run parallel to one another or at a slight angle) to insert the next strand of hair and heat and style it. Handling is thus essentially simplified due to the forced guidance of the hair strand, and the styling result is of the desired quality and is reproducible in a manner that depends less on handling.

The invention claimed is:

1. A hair-styling device comprising:

an elongated heater comprising opposed semi-cylindrical styling paddles, each paddle having a curved outer surface and a heatable inner surface, the outer and inner surfaces meeting at styling edges configured to alter a curvature of hair heated by the inner surface before the hair is cooled on the curved outer surface; and hair guides adjustably mounted circumferentially about the outer surfaces of the semi-cylindrical styling paddles, wherein the hair guides each comprise guide edges arranged to guide hair between the styling paddles and the hair guides, and wherein the guide edges and the styling edges are substantially parallel, and wherein the guides and the styling paddles are rotatable with resect to each other.

2. The hair-styling device of claim 1, wherein the guides and the styling paddles are rotatable with respect to each other about the cylindrical axis of the elongated heater.

3. The hair-styling device of claim 1, further comprising a motor drive configured to rotate the guides and the styling paddles relative to each other.

4. The hair-styling device of claim 3, further comprising a sensor system arranged to control the motor drive and to detect a use state of the device.

5. The hair-styling device of claim 1, wherein the guides comprise concave inner surfaces and are pivotable about a guide pivot axis toward each other to define an opening between the concave surfaces when the free ends of the guides are fully pivoted toward each other in a closed position.

6. The hair-styling device of claim 1, further comprising a compression spring arranged to force the guides into a closed position.

7. The hair-styling device of claim 1, wherein the styling paddles are pivotable about a styling paddle pivot axis, and wherein the guide pivot axis and the styling paddle pivot axis are rotatable up to 180° about the cylindrical axis of the elongated heater when the free ends of the guides are fully pivoted toward each other in a closed position.

8. The hair-styling device of claim 7, wherein the hair-styling device is configured such that relative rotation of the styling paddles with respect to the guides is coupled to pivoting of the free ends of the guides toward each other.

9. The hair-styling device of claim 7, wherein a relative rotation of the styling paddles and the guides is enabled when the free ends of the guides and the free ends of the styling paddles are fully pivoted toward each other in the closed positions.

10. The hair-styling device of claim 7, wherein the styling paddles are secured in a rotated position relative to the guides when the free ends of the styling paddles are fully rotated toward each other in the closed position.

11. The hair-styling device of claim 7, wherein the styling paddles are coupled to a bearing pin positioned between the guides, the bearing pin aligned along the cylindrical axis of the elongated heater and the styling paddles rotatable about the bearing pin.

* * * * *

UNITED STATES PATENT AND TRADEMARK OFFICE

CERTIFICATE OF CORRECTION

PATENT NO. : 8,232,505 B2
APPLICATION NO. : 12/376479
DATED : July 31, 2012
INVENTOR(S) : Sebastian Hottenrott et al.

It is certified that error appears in the above-identified patent and that said Letters Patent is hereby corrected as shown below:

*Column 10*

Line 18, delete “resect” and insert --respect--.

Signed and Sealed this
Twenty-fifth Day of September, 2012

David J. Kappos

David J. Kappos
*Director of the United States Patent and Trademark Office*